US011267150B1

(12) United States Patent
Smith

(10) Patent No.: US 11,267,150 B1
(45) Date of Patent: Mar. 8, 2022

(54) ROLLED MATERIAL DISPENSER

(71) Applicant: Gailia Smith, Jonesboro, AR (US)

(72) Inventor: Gailia Smith, Jonesboro, AR (US)

( * ) Notice: Subject to any disclaimer, the term of this patent is extended or adjusted under 35 U.S.C. 154(b) by 244 days.

(21) Appl. No.: 16/414,639

(22) Filed: May 16, 2019

Related U.S. Application Data

(60) Provisional application No. 62/672,434, filed on May 16, 2018.

(51) Int. Cl.

| | |
|---|---|
| ***B26D 1/10*** | (2006.01) |
| ***B65H 16/06*** | (2006.01) |
| ***B65H 16/00*** | (2006.01) |
| ***B65H 35/00*** | (2006.01) |

(52) U.S. Cl.
CPC ..... *B26D 1/105* (2013.01); *B65H 16/005* (2013.01); *B65H 16/06* (2013.01); *B65H 35/0086* (2013.01)

(58) Field of Classification Search
CPC ..... B26D 1/01; B26D 1/04; B26D 1/045; B26D 1/10; B26D 1/105; B65H 35/00; B65H 35/0073; B65H 35/008; B65H 35/0086
USPC ..... 83/613–614
See application file for complete search history.

(56) References Cited

U.S. PATENT DOCUMENTS 3,722,767 A * 3/1973 Struble ..... B65D 83/0882 225/49
4,676,861 A * 6/1987 Bishop ..... B41J 29/367 156/527
4,851,074 A * 7/1989 Hiromichi ..... B65C 11/004 156/541
4,851,076 A * 7/1989 Manusch ..... B05C 1/14 156/577
4,960,022 A * 10/1990 Chuang ..... B26D 1/105 83/175
5,036,740 A * 8/1991 Tsai ..... B26D 1/105 83/455
5,107,734 A * 4/1992 Armbruster ..... B26D 5/08 83/205
5,133,980 A * 7/1992 Ream ..... B65H 35/002 426/115
5,186,376 A * 2/1993 Scharf ..... B26D 7/2614 225/42
5,222,644 A * 6/1993 Moreno ..... B65H 35/002 225/19

(Continued)

*Primary Examiner* — Sean M Michalski
*Assistant Examiner* — Richard D Crosby, Jr.
(74) *Attorney, Agent, or Firm* — Schrantz Law Firm, PLLC; Stephen D. Schrantz

(57) ABSTRACT

The rolled material dispenser of the present invention enables the user to securely grip the rolled material dispenser and safely cut rolled material installed within. The rolled material dispenser provides beveled corners allowing for better gripping and usage for users with decreased hand strength and dexterity. The user inserts the rolled material of their choice into the dispenser. The user opens the lid of the rolled material dispenser, pulls a desired length of material from the roll installed inside the dispenser device, and then closes the lid. Closing the lid secures the rolled material and positions the cutting device to sever the desired length of material. The cutting device travels along the track of the lid. The user slides the cutting device across the rolled material positioned underneath the lid to cut a portion of material from the roll installed within the dispenser.

20 Claims, 10 Drawing Sheets

(56) References Cited

U.S. PATENT DOCUMENTS 5,358,140 A * 10/1994 Pellegrino ..... A61F 15/001 206/440
5,440,961 A * 8/1995 Lucas, Jr ..... B26D 1/185 83/455
6,405,913 B1 * 6/2002 Passamoni ..... B26F 3/02 225/43
6,564,942 B1 * 5/2003 Shiftier ..... B65D 83/0805 206/395
7,424,843 B2 * 9/2008 Guillory ..... B26D 1/045 225/39
9,764,922 B2 * 9/2017 Sharp ..... B65H 75/185
10,737,874 B2 * 8/2020 Pourian ..... B65D 25/22
10,781,067 B2 * 9/2020 Smith ..... B65H 35/0086
2002/0117038 A1 * 8/2002 Vegliante ..... B26D 1/045 83/578
2003/0140760 A1 * 7/2003 Bory ..... B65H 35/0086 83/614
2004/0007606 A1 * 1/2004 Baker, Jr. ..... B65H 35/002 225/1
2004/0040429 A1 * 3/2004 Nichols ..... B26D 1/105 83/455
2004/0237746 A1 * 12/2004 Schultz ..... B65H 35/0086 83/614
2005/0005755 A1 * 1/2005 Turvey ..... B65D 83/0882 83/614
2005/0034584 A1 * 2/2005 Antal ..... B26D 1/065 83/614
2005/0035133 A1 * 2/2005 Gerulski ..... B65H 35/0086 221/31
2005/0166738 A1 * 8/2005 Hsu ..... B65D 83/0882 83/614
2006/0202079 A1 * 9/2006 Pavlik ..... B65H 35/0086 242/562
2007/0000935 A1 * 1/2007 Pavlik ..... B26D 1/045 221/33
2007/0022857 A1 * 2/2007 Schreiter ..... B26D 1/045 83/614
2007/0044617 A1 * 3/2007 Pavlik ..... B26D 1/045 83/614
2007/0137454 A1 * 6/2007 DesRosiers ..... B26D 1/045 83/614
2009/0293695 A1 * 12/2009 Sacchetta ..... B65H 35/002 83/614
2011/0209594 A1 * 9/2011 Withers ..... B65H 35/0086 83/614
2012/0111169 A1 * 5/2012 Blalock ..... B26D 7/015 83/614
2014/0096659 A1 * 4/2014 Choi ..... B65H 35/04 83/485
2015/0290823 A1 * 10/2015 Yasui ..... B26D 1/0006 83/613

* cited by examiner

ROLLED MATERIAL DISPENSER

CROSS-REFERENCE TO RELATED APPLICATIONS

This application claims priority to and is a continuation in part of U.S. patent application Ser. No. 62/672,434 entitled "ROLLED MATERIAL DISPENSER" filed on May 16, 2018.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates generally to a rolled material dispenser. The rolled material dispenser provides a rod that is secured in place by an endcap. The rod receives various types of rolled material including but not limited to gift wrap. The end cap of the rolled material dispenser then secures the rod and material inside the dispenser body. A dispenser lid is attached to the dispenser body. The dispenser lid provides a cutting apparatus, allowing the user to remove the desired amount of rolled material from the roll. The dispenser also provides beveled edges for easier gripping.

In the known art, the dispensers are difficult to grip for certain persons. Users with arthritis and other conditions that affect hand strength and dexterity have difficulty gripping an object with so few contact surfaces. The present invention enables users with decreased hand strength to cut the rolled material safely and effectively. The beveled edges of the present invention provide additional gripping surface. The bevels provide contact points at various angles. The user's hand may contact the wrap cutting device in more locations and at different angles.

The known art does not provide these beveled edges. The known art limits the amount of contact a person with decreased hand strength and dexterity can make with these devices, making it harder for them to use these devices.

Similarly, the cutting devices of the known art are flush with the dispenser or generally small and unstable. Small or flat cutting devices are difficult for users with decreased hand strength and dexterity to grip. The cutting device of the present invention provides a cutting device with extended cutting body to allow the user to better and more safely use the cutting device.

The rolled material dispenser of the present invention overcomes many disadvantages of the known art. The rolled material dispenser provides beneficial features not found in currently available devices. In view of the foregoing, the rolled material dispenser of the present invention is well suited for providing a safe, effective method of dispensing and cutting rolled material. Therefore, the present invention is needed to provide a more effective device for dispensing rolled material.

II. Description of the Known Art

Patents and patent applications disclosing relevant information are disclosed below. These patents and patent applications are hereby expressly incorporated by reference in their entirety.

U.S. Pat. No. 7,000,520 issued to Nichols et al. on Feb. 21, 2006 (the '520 patent) teaches a roll supporting slide cutter assembly incorporating a traversable cutter tab that is capable of being supported within a carton enclosure associated with a wrap material roll. The cutter assembly taught by the '520 patent extends lengthwise from the body. An edge of the rolled material is then unwound and makes contact with the cutter assembly. The cutting assembly then separates the section of rolled material from the roll contained within the carton.

U.S. Pat. No. 7,424,843 issued to Guillory on Sep. 16, 2008 (the '843 patent) teaches a wrapping paper storage device and dispenser. The device taught in the '843 patent supports a sheet of wrapping paper between the top wall of the dispenser and a flap member. The flap member provides a flap slot. A cutter taught by the '843 patent traverses the flap slot, making contact with the hard flat polymeric sheet below. This separates the material from the roll. The '843 patent also teaches that the cutter may be detachable and consist solely of a razor blade.

SUMMARY OF THE INVENTION

The rolled material dispenser of the present invention provides a safe and convenient method of cutting a portion of material from a roll of the material. This includes but is not limited to wrapping paper, saran wrap, plastic wrap, and foil. The rolled material dispenser provides a dispenser body. A rod is located inside the dispenser body. The user places a roll of material onto the rod within the dispenser. The end cap of the dispenser body rod secures the rod within the dispenser body. The end cap and dispenser body end provide rod installation apertures that support the rod and secure the rod in place.

The end cap, dispenser body, and lid provide at least one beveled edge. In one embodiment, the rolled material dispenser provides three beveled edges in which the front lower edge is not beveled. In another embodiment, the rolled material dispenser provides two beveled edges in which the front and rear upper edges are beveled. These bevels run horizontally along the dispenser body, providing the user with a contoured contact area.

The lid of the wrap dispenser extends from the back of the dispenser body, over the rolled material, and to the base of the dispenser body. The lid of the wrap dispenser provides at least one beveled edge. The lid also provides a track and cutting device to sever a section of the rolled material from the roll within the dispenser body.

The cutting device moves along the track in the dispenser lid. The track runs horizontally along the front facing long edge of the dispenser. The cutting device provides a blade that severs a segment of material from the roll, and an extended cutting body to allow the user to easily move the cutting device along the track. The cutting device traverses the track along the width of the roll of material.

In one embodiment, the rolled material dispenser provides a stopper. The stopper allows the user to utilize rolls of material that are shorter than the rod in the rolled material dispenser. Turning a knob on the stopper allows the user to secure the stopper in place to secure the shorter roll of material on the rod within the rolled material dispenser.

The present invention provides a method of quickly and easily removing a section of material from a roll of material. Many different materials such as wrapping paper and cooking foil are sold in rolls. The present invention allows persons with decreased hand strength and dexterity to safely and effectively remove a section of the desired length from the roll.

It is an object of the present invention to provide a reliable method of removing a segment of unrolled material from a roll.

It is an object of the present invention to assist users with decreased hand strength.

It is an object of the present invention to assist users with decreased hand dexterity.

It is an object of the present invention to increase comfort of the user.

It is an object of the present invention to allow for easier removal of a segment of rolled material from a roll.

It is also an object of the present invention to provide an aesthetically pleasing design.

These and other objects and advantages of the present invention, along with features of novelty appurtenant thereto, will appear or become apparent in the course of the following descriptive sections and the attached drawings.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

The present invention relates generally to a rolled material dispenser 100. The rolled material dispenser 100 provides cutting device 102 to remove a section of rolled material that is stored on rod 116 of rolled material dispenser 100. The rolled material may be one of many materials including but not limited to wrapping paper, aluminum foil, or plastic wrap.

Figure 1A:
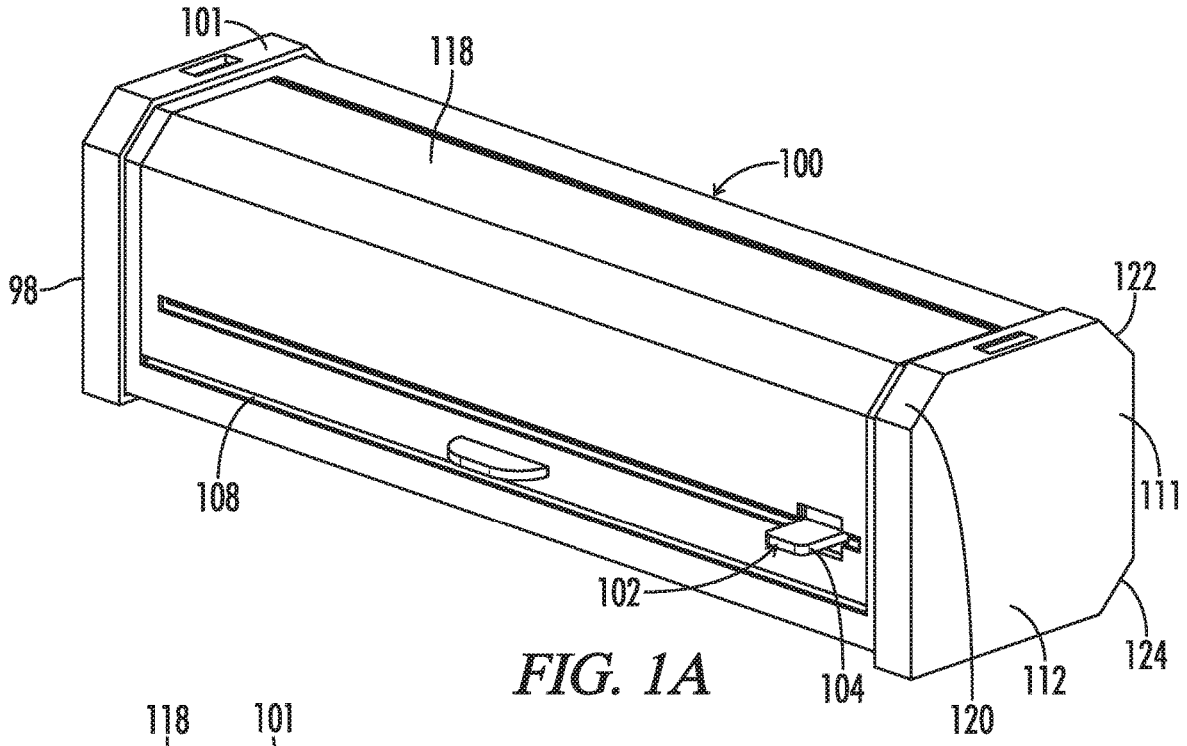
FIG. 1A is a perspective view of one embodiment of the present invention.
Figure 1B:
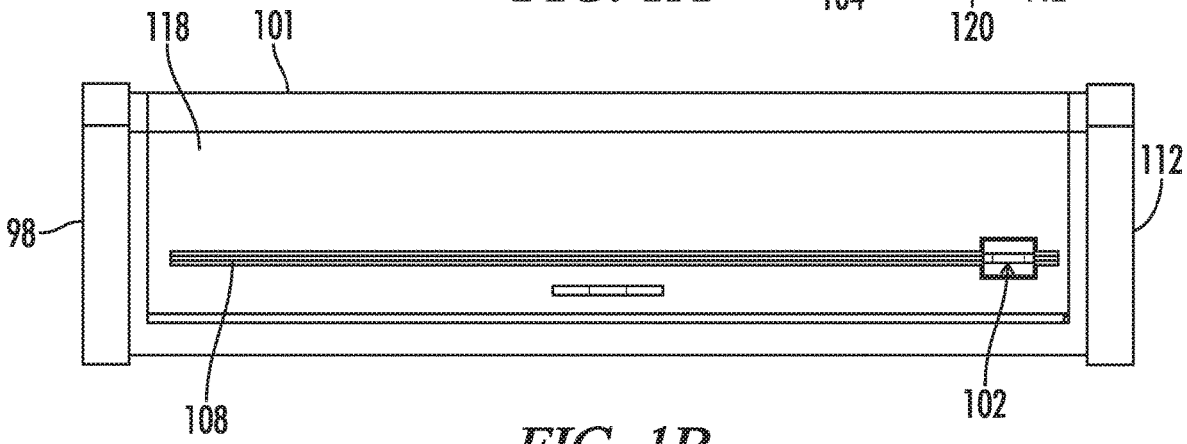
FIG. 1B is a front view thereof.
Figure 1C:
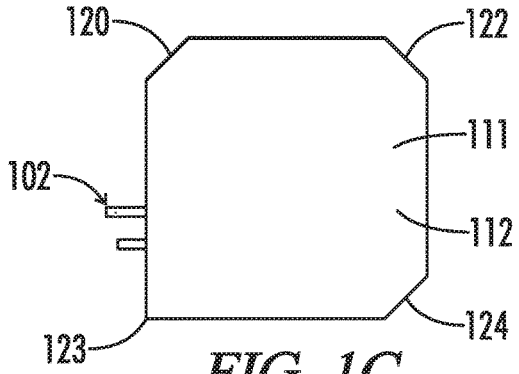
FIG. 1C is a right side view thereof, the left side being a mirror image of the right side view.

FIGS. 1A-1C show an environmental view of one embodiment of the rolled material dispenser 100. Rod 116 receives the rolled material of the user's choice. End cap 112 secures rod 116 inside dispenser body 101. Lid 118 is attached to the dispenser body 101. Lid 118 extends over and covers the rolled material inside dispenser body 101. Lid 118 also contacts dispenser lip 130.

The user dispenses the desired amount of material from the roll of material. The material to be removed from the roll is placed between dispenser lip 130 and lid 118.

Cutting device 102 moves along track 108 to cut the material. The user slides the cutting device across the material by applying pressure to cutting body 104. The user then cuts the desired amount of material from the roll. The user cuts the material with the cutting device. Blade 106 of cutting device 102 severs the segment of rolled material from the roll installed within the dispenser body.

In one embodiment, rolled material dispenser 100 provides bevel 120, bevel 122, and bevel 124. These bevels form a contoured surface of the rolled material dispenser 100, allowing users with decreased hand strength and dexterity to more easily grip the rolled material dispenser 100. Corner 123 of one embodiment is not beveled.

Figure 1D:
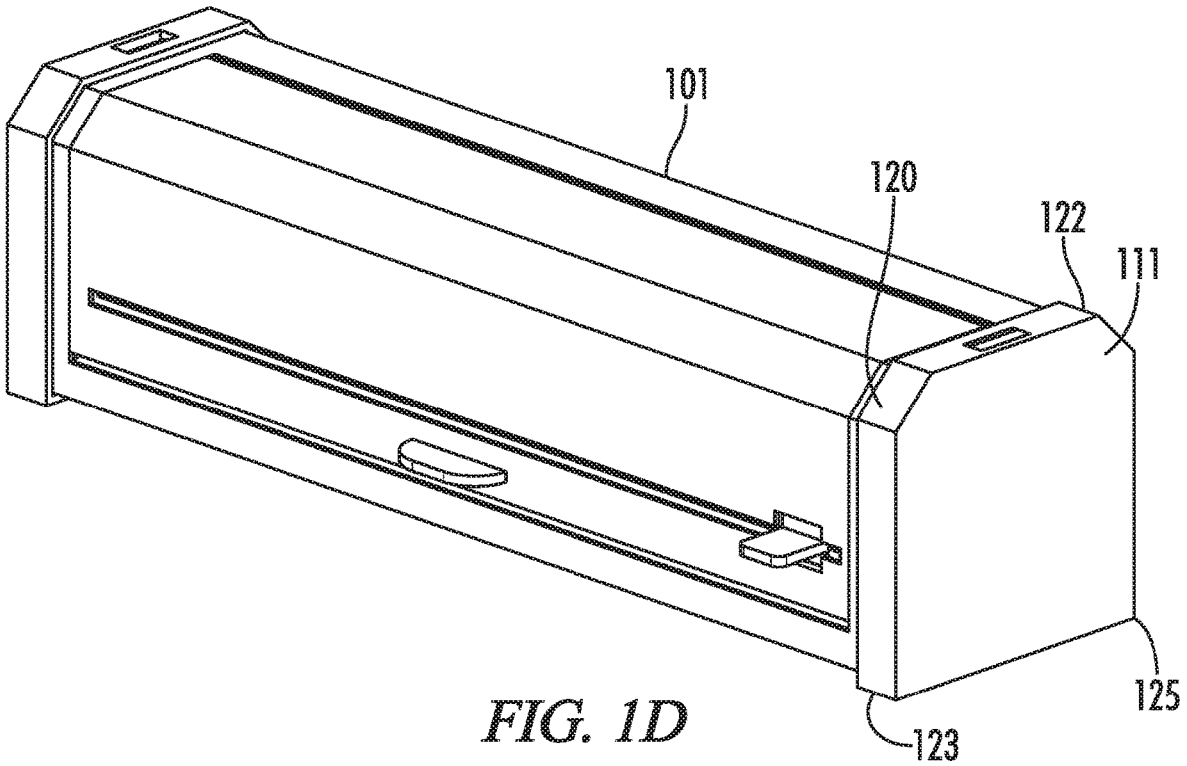
FIG. 1D is a perspective view of one embodiment of the present invention.
Figure 1E:
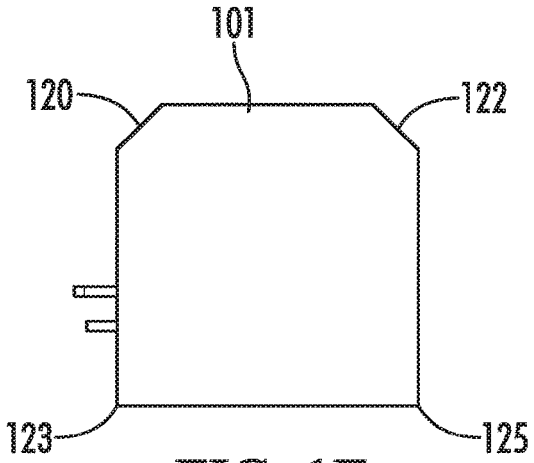
FIG. 1E is a right side view thereof, the left side being a mirror image of the right side view.

FIGS. 1D-1E show another embodiment of the present invention. different views of one embodiment of the present invention. Dispenser body 101 of this embodiment provides bevels 120, 122. Dispenser body provides corners 123, 125 that lead directly to the base to the front wall and the rear wall without the bevel. In one embodiment, corners 123, 125 are ninety degree angles.

Figure 2A:
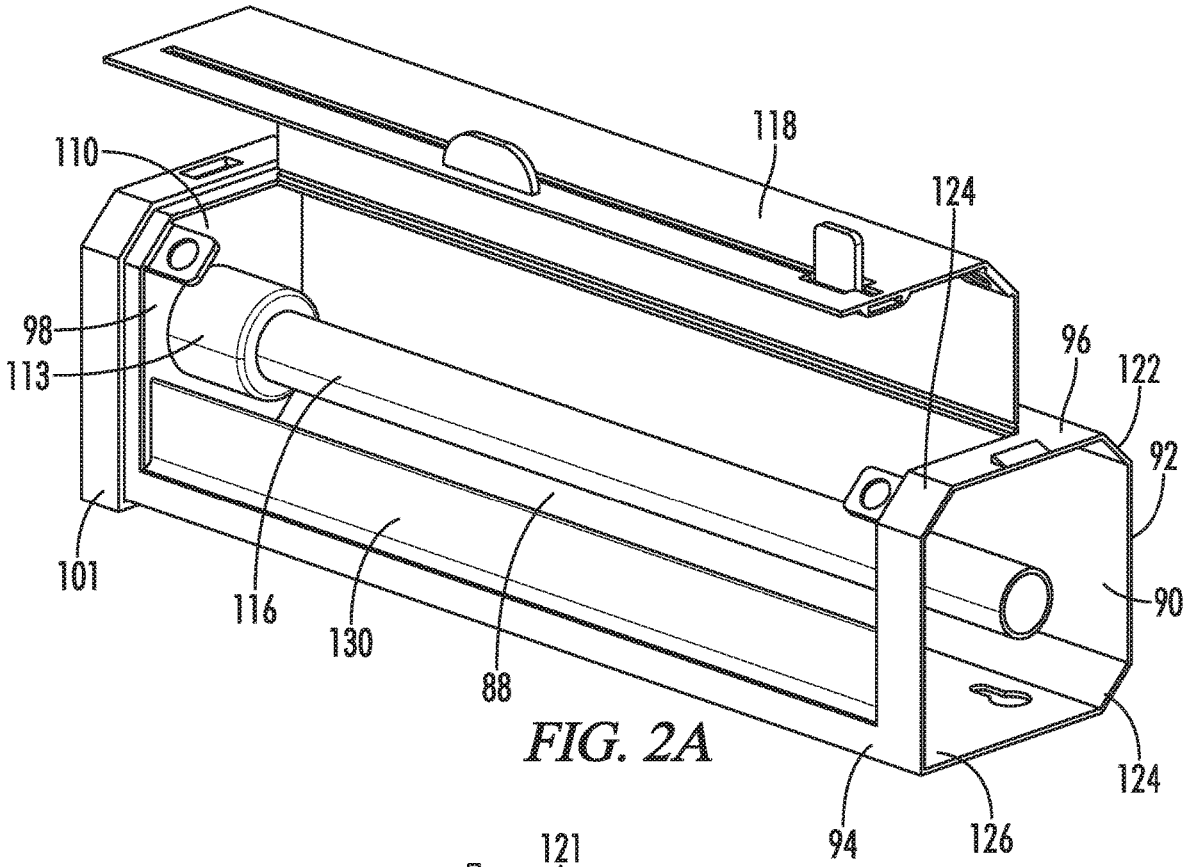
FIG. 2A is a perspective view of a dispenser body of one embodiment of the present invention.
Figure 2B:
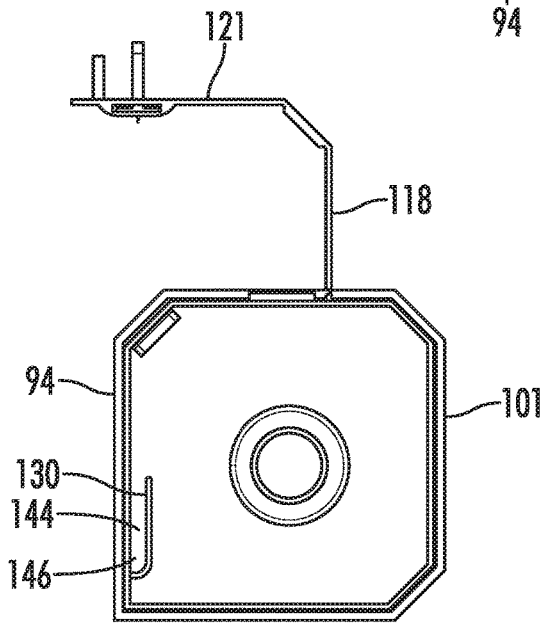
FIG. 2B is a sectional right side view thereof.
Figure 2C:
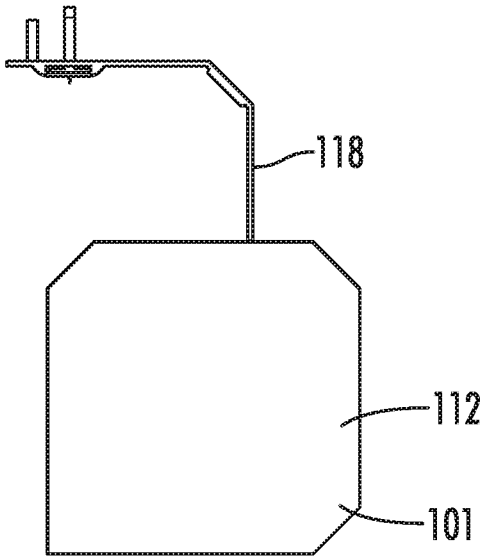
FIG. 2C is a right side view of one embodiment of the present invention.

FIGS. 2A-2C show a perspective view of one embodiment of the dispenser 100. Dispenser body 101 provides dispenser base 126, a dispenser end 110 forming a side wall 98, rod 116, dispenser lip 130, and connection arm 133. Dispenser end 110 provides rod installation aperture 113, which supports rod 116 within the dispenser body. Dispenser end 110 also provides at least one bevel. In this embodiment, dispenser end 110 provides three bevels. Bevel 120, bevel 122, and bevel 124 form a contoured surface of the dispenser, allowing the user to easily grip and carry the rolled material dispenser 100. Dispenser lip 130 serves as the smooth surface across which the cutting device travels to sever the segment of material from the roll. FIGS. 2*b*-2*f* show different views of one embodiment of the dispenser body of the present invention.

The dispenser body 101 provides a housing for placement of the rod and the rolled material. The dispenser body forms a side wall 98 at dispenser end 110 a partial top wall 96, a partial front wall 94, a rear wall 92, and a side opening 90 located at the end opposite of the side wall 98. End cap attaches to the dispenser body 101 to form a side wall 111 opposite side wall 98. In one embodiment, side wall 98 is an end cap similar to end cap 112 that removably attaches the dispenser body 101.

Dispenser body 101 also provides a dispensing aperture 88. Lid 118 adjusts between a closed position shown in FIG. 1 and an open position shown in FIG. 2. The lid 118 adjusted to the closed position shown in FIG. 1 closes the dispensing aperture 88. Opening lid 118 exposes the dispensing aperture 88 to allow egress of the rolled material from the dispenser body 101 through the dispensing aperture 88. The user can then close the lid 118 to retain the rolled material and cut a portion of the rolled material via the blade 106.

The dispensing aperture 88 creates an opening in the front and top of the dispensing body 101. The dispensing aperture extends from the front wall 94 through the top wall. Lid 118 attaches to the top wall 96 and adjusts to the closed position to limit access into the dispensing device 101 through the top and front. Closing the lid 118 closes the front and the top.

FIG. 2B also shows the exit 146 of the dispensing body. The front wall 94 provides some separation from the dispenser lip 130 to form the adjustment aperture 144 and exit 146. The lid 118 and the front portion 121 of the lid form a space between dispenser lip 130 such that the lid does not contact the dispenser lip 130 of one embodiment. Such an adjustment aperture 144 extends downward from the track to the exit allowing removal of the portion of the material. The adjustment aperture 144 also provides space such that the lid does not completely restrict movement of the material at the cutting point.

Figure 3A:
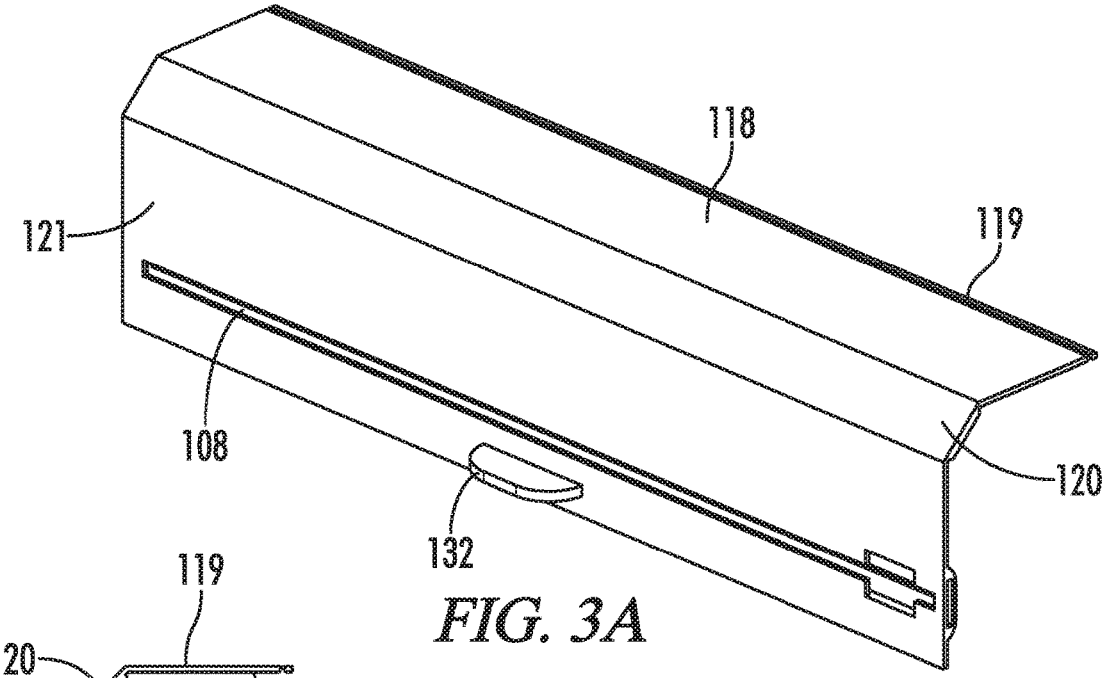
FIG. 3A is a perspective view of the lid of one embodiment of the present invention.
Figure 3B:
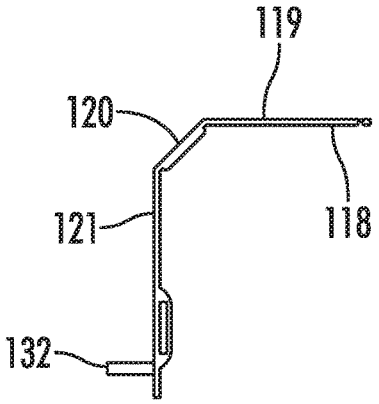
FIG. 3B is a right side view thereof, the left side view being a mirror image of the right side view.

FIGS. 3A and 3B show one embodiment of lid 118 of the rolled material dispenser 100. Lid 118 provides track 108, cutting device 102, bevel 120, and closing finger 132. The user opens lid 118 and unrolls the desired length of material needed from the roll on rod 116. The desired length of material extends out of the dispenser body 101.

The user then closes lid 118 to contact and secure the material. The closed lid 118 limits movement of the material to allow for improved cutting of the material. Closing lid 118 retains the segment of rolled material in place and limits movement of the material. The lid 118 also secures the material in a flat position to assist with cutting the material.

The lid 118 pivotally attaches to the dispensing body. In one embodiment, the lid 118 pivotally attaches to the top wall of the dispensing body. The lid provides an upper section 119 that forms a top portion of the lid 118. Bevel 120 angles downward from upper section 119. Front section 121 extends vertically downward from the upper section 119. The upper section 119 serves as a component of the top wall of the dispensing body to close the dispensing aperture along the top of the dispensing body. The front section 121 serves as a component of the front wall of the dispensing body to close the dispensing aperture along the front of the dispensing body.

The user then moves cutting device 102 horizontally along track 108. This movement causes blade 106 of cutting device 102 to travel across the material to sever the desired length of rolled material from the roll installed on rod 116. FIGS. 3*b*-3*c* show different views of the lid of one embodiment of the present invention.

Figure 4A:
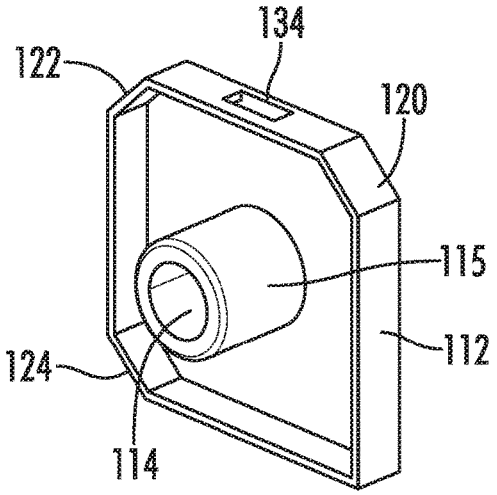
FIG. 4A is a perspective view of the end cap of one embodiment of the present invention.
Figure 4B:
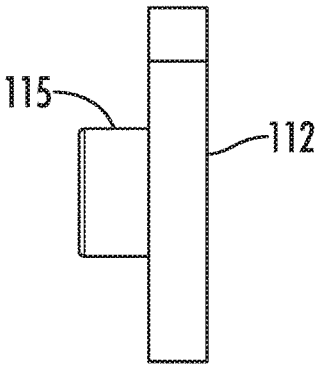
FIG. 4B is a right side view thereof.

FIGS. 4A and 4B show an end cap of one embodiment of the present invention. End cap 112 detaches from the dispenser to enable the user to install, remove, replace, or otherwise change the rolled material within the dispenser 100. The user removes end cap 112 to access the rod 116. With access to rod 116, the user can install, remove, replace, or otherwise change the rolled material installed on rod 116 of the dispenser 100.

End cap 112 provides rod installation aperture 114 and attachment finger 115. Attachment finger 115 extends laterally outward from the ends of the dispensing body to support the rod. Rod installation aperture 114 within the attachment finger 115 supports and secures rod 116. End cap 112 removably attaches to dispenser body 101 for placement of rod 116 between dispenser end 110 and end cap 112. Rod installation aperture 114 of end cap 112 and rod installation aperture 113 of dispenser end 110 support and suspend rod 116 inside dispenser body 101. In one embodiment, rod 116 remains in a fixed position. In another embodiment, rod 116 rotates.

As discussed above, end cap 112 attaches to dispenser body 101. Attachment finger 133 of dispenser body 101 inserts into attachment aperture 134 to attach the end cap 112 to dispenser body 101. The user removes the attachment finger 133 from the attachment aperture 134 to release the end cap 112 from the dispenser body 101.

End cap 112 provides at least one bevel. In this embodiment, there are three bevels. Bevel 120, bevel 122, and bevel 124 begin at dispenser end 110 and extend lengthwise along the dispenser lid 118 and dispenser body 101 to end cap 112.

Figure 5A:
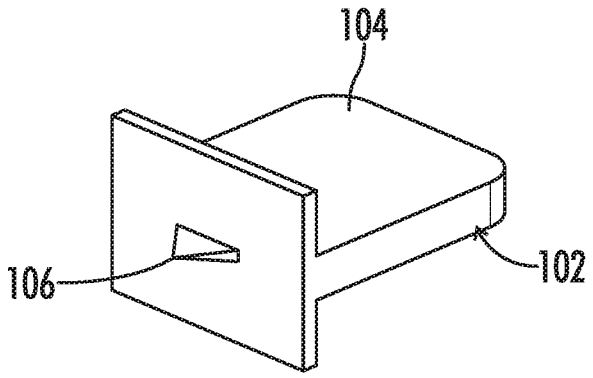
FIG. 5A is a perspective view of the cutting device of one embodiment of the present invention.
Figure 5B:
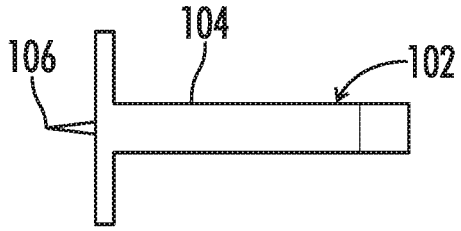
FIG. 5B is a right side view thereof, the left side view being a mirror image of the right side view thereof.

FIGS. 5A and 5B show cutting device 102 of the present invention. Cutting device 102 is located within track 108 of lid 118 of the rolled material dispenser 100. Cutting body 104 extends outward away from dispenser body 101. Blade 106 of cutting device 102 extends from the cutting device inward towards dispenser lip 130 of dispenser body 101. Blade 106 severs material contained between lid 118 and dispenser lip 130 when moved horizontally along track 108. Cutting body 104 provides a large gripping surface allowing the user to easily contact cutting body 104 and move it along track 108 to remove a segment of material of the desired length from the roll of material stored on rod 116.

Figure 6:
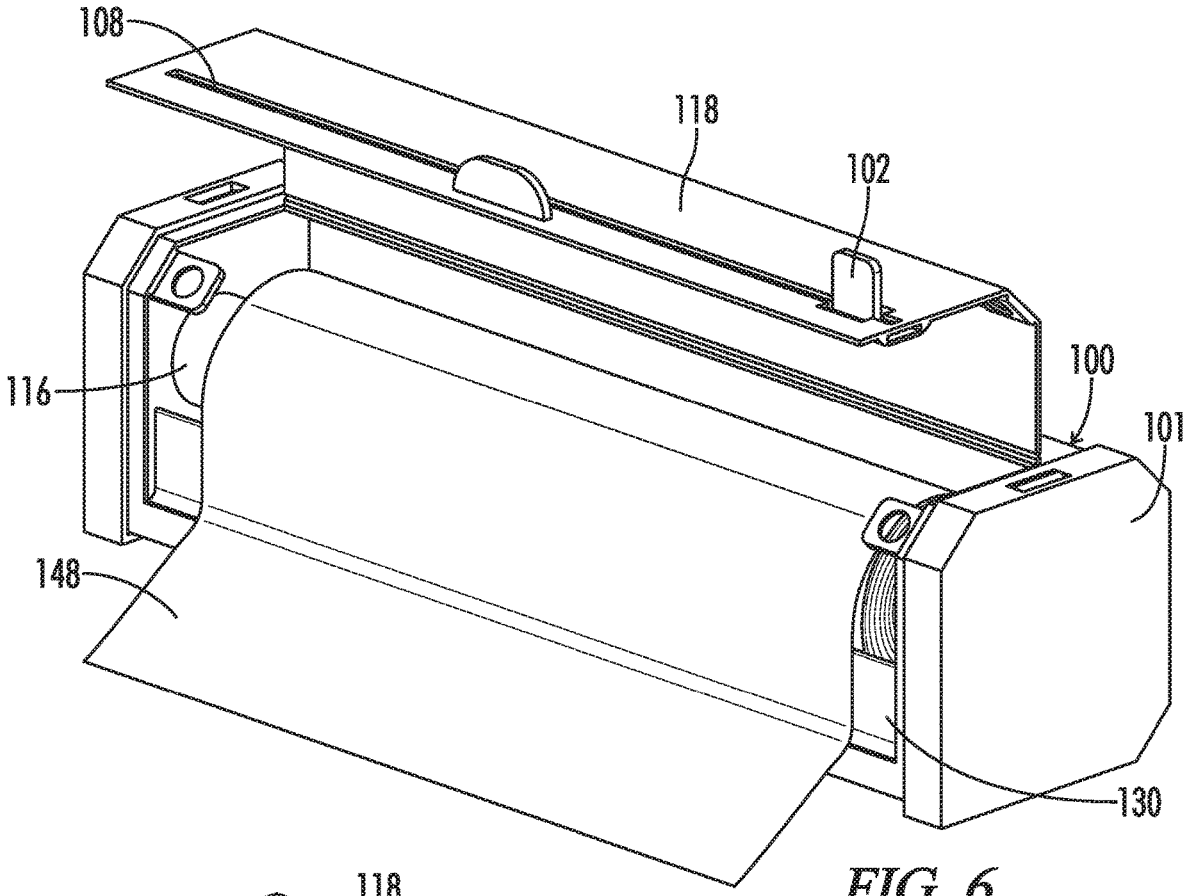
FIG. 6 is an environmental view of one embodiment of the present invention.
Figure 7:
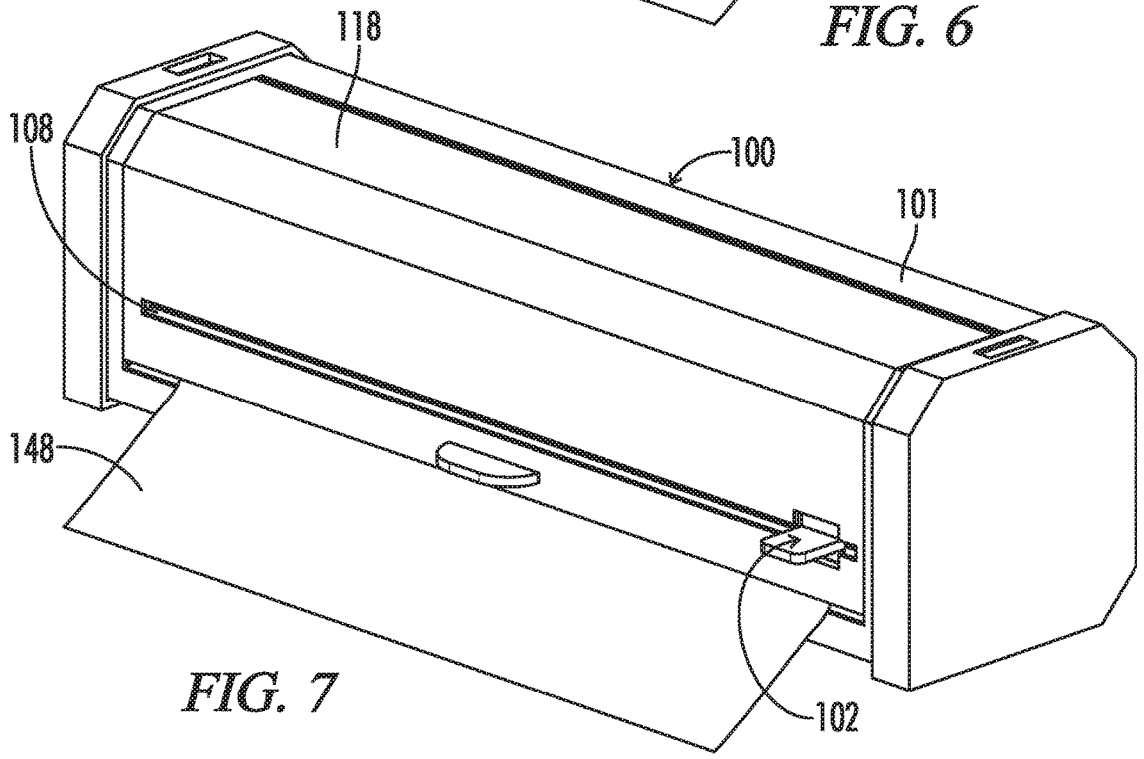
FIG. 7 is an environmental view thereof.

FIGS. 6 and 7 show an environmental view of the dispenser body 101 of one embodiment in use. The user lifts lid 118 and pulls the desired amount of material 148 from the roll stored on rod 116 as shown in FIG. 6.

After pulling the desired amount of the material 148 from the roll, the user closes lid 118 as shown in FIG. 7. Closing lid 118 secures the material in place between lid 118 and dispenser lip 130. The closed lid 118 positions cutting device 102 for use. The user then severs the material from the roll by sliding cutting device 102 along track 108. The user moves cutting device 102 along the track 108 across the material 148. Blade of cutting device 102 severs the material 148 from the roll to remove the desired amount of material 148 from the roll.

Figure 8A:
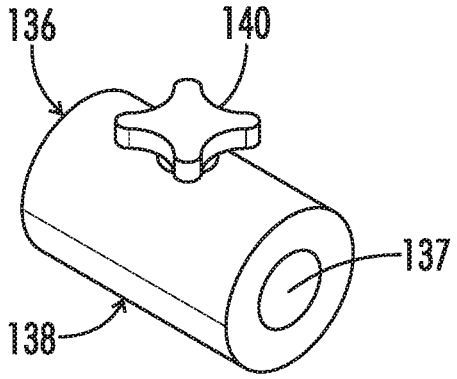
FIG. 8A is a perspective view of a stopper of one embodiment of the present invention.
Figure 8B:
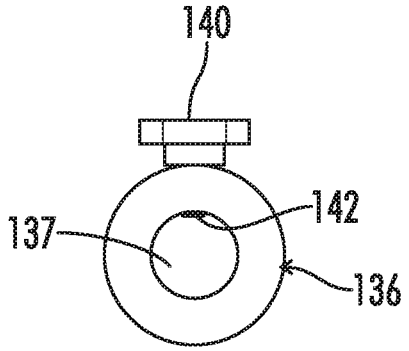
FIG. 8*b* is a right side view thereof, the left side view being a mirror image of the right side view thereof.

FIGS. 8A and 8B show stopper 136 of one embodiment of the present invention. Stopper body 138 of stopper 136 slides over rod 116. Rod 116 inserts into opening 137 of the stopper 136. Fastener 142 of stopper 136 secures the stopper 136 to rod 116. The knob 140 limits movement of the stopper 136 on the rod 116.

Turning fastener head 140 raises and lowers fastener 142. Fastener 142 extends through the opening 137. The fastener 142 contacts rod 116 to secure the stopper 136 onto the rod 116 and limit movement of the stopper 136 on the rod 116.

Figure 9:
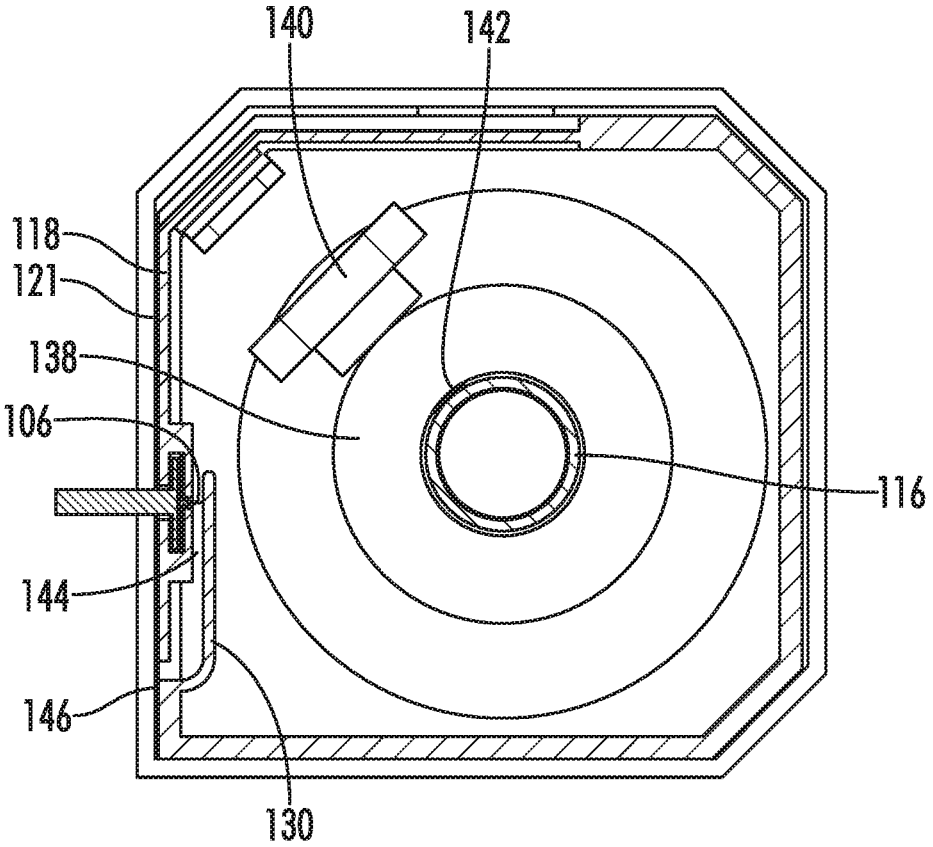
FIG. 9 is a sectional view of one embodiment of the present invention.

FIG. 9 shows a right side view of one embodiment of the rolled material dispenser. Stopper 136 allows rod 116 to accept rolls of wrapped material having different widths. The stopper 136 secures to the rod to limit lateral movement of the rolled material.

Turning fastener head 140 in a first direction lowers fastener 142 to contact rod 116 and secure stopper 136 in place. Turning fastener 140 in a second direction raises fastener 142 away from rod 116 to allow the stopper 136 to move freely along rod 116.

FIG. 9 also shows the travel path of the rolled material through an exit 146 of the dispensing body. Adjusting the lid 118 to the closed position forms an adjustment aperture 144 and exit 146. The lid 118 and the front portion 121 of the lid form a space between dispenser lip 130 such that the lid does not contact the dispenser lip 130 of one embodiment. Such an adjustment aperture 144 extends downward from the track to the exit allowing removal of the portion of the material. The adjustment aperture 144 also provides space such that the lid does not completely restrict movement of the material.

Figure 10:
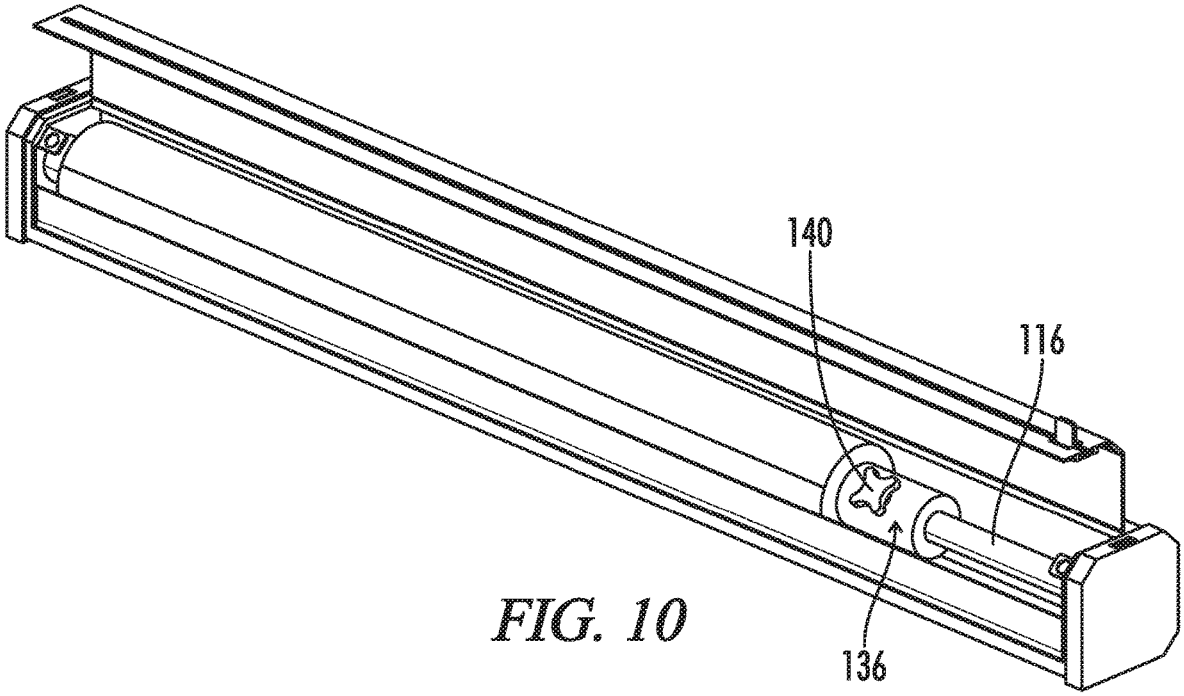
FIG. 10 is a perspective view of one embodiment of the present invention.

FIG. 10 shows an environmental view of one embodiment of the present invention. Stopper 136 secures a roll of material that is shorter than rod 116 in place so that the user can safely and efficiently remove a segment of rolled material from a roll contained within the rolled material dispenser. The user tightens fastener 140 to limit movement of stopper 136 on the rod 116.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A rolled material dispensing device for dispensing a rolled material longitudinally forward from the device and cutting a portion of the rolled material, the device comprising:

a dispenser body in which the rolled material is positioned;

a base of the dispenser body;

a front wall of the dispenser body extending vertically upward from the base;

a top wall of the dispenser body;

a dispensing aperture of the dispenser body located vertically above the front wall to provide an exit of the rolled material from the dispenser body longitudinally forward through the dispensing aperture;

a lid secured to the dispenser body wherein the lid adjusts to an open position that exposes the dispensing aperture and a closed position that reduces a vertical opening of the dispensing aperture, wherein the dispensing aperture is formed vertically between the front wall and the lid;

a blade secured to the lid;

a track in the lid wherein the blade travels laterally across the track in the lid; and a dispenser lip secured to the front wall wherein the dispenser lip extends longitudinally rearward from the front wall and then extends vertically upward longitudinally behind the front wall, wherein the dispenser lip extends vertically above the dispensing aperture at a position located longitudinally behind the front wall.

2. The device of claim 1, wherein the dispenser lip curves upward along a longitudinal axis when extending longitudinally rearward from the front wall, wherein the dispenser lip is fixed to the front wall, wherein the dispenser lip extends longitudinally behind the front wall towards a rear wall of the dispenser body.

3. The device of claim 2 further comprising:

a front end of the dispenser lip located below the dispensing aperture, wherein the front end of the dispenser lip is fixed to the front wall a top of the dispenser lip located longitudinally rearward of the front end, wherein the top is located vertically above the dispensing aperture;

wherein the lid adjusted to the closed position maintains vertical separation from the front wall to form a vertical opening between the front wall and the lid for the dispensing aperture;

wherein the dispenser lip extends vertically above a portion of the front wall through which the dispensing aperture extends, wherein an upper surface of the front end of the dispenser lip is located vertically below the dispensing aperture and the lid in the closed position, wherein the upper surface of the dispenser extends longitudinally behind the dispensing aperture, wherein the upper surface at the top of the dispenser lip extends vertically upward above the dispensing aperture at a position located longitudinally behind the dispensing aperture.

4. The device of claim 3 wherein the top of the dispenser lip extends vertically above the track when the lid is adjusted to the closed position such that the blade travels vertically below the top of the dispenser lip when the lid is adjusted to the closed position, wherein the track is located vertically above the dispensing aperture.

5. The device of claim 3 wherein the track extends laterally across the lid wherein the blade travels laterally across the lid; and wherein the dispenser lip extends vertically above the track when the lid is adjusted to the closed position such that the blade travels along a lateral path vertically between the front end of the dispenser lip and the top of the dispenser lip when the lid is adjusted to the closed position;

wherein the track is located vertically above the dispensing aperture.

6. The device of claim 1 further comprising:

an upper portion of the lid that pivotally attaches to the dispensing body, wherein the upper portion of the lid obstructs the dispensing aperture through the top of the dispensing body when the lid is adjusted to the closed position; and a front portion of the lid wherein the front portion extends vertically downward from the upper portion, wherein the front portion of the lid obstructs the dispensing aperture through the front of the dispensing body when the lid is adjusted to the closed position.

7. The device of claim 6 wherein the track extends laterally across the front portion of the lid and the blade is secured to the front portion of the lid, wherein the track is located vertically above the dispensing aperture.

8. The device of claim 6 further comprising:

a side wall of the dispensing body;

an end cap that attaches to the dispensing body opposite of the side wall, wherein the end cap detaches and attaches to the dispensing body;

a front bevel secured to the front wall and the top wall wherein the front bevel angles downward from the top wall towards the front wall;

a lid front bevel wherein the lid front bevel angles downward from the upper portion of the lid to the front portion of the lid, wherein the front bevel and the lid front bevel extends from the side wall to the end cap when the lid is adjusted to the closed position.

9. The device of claim 8 further comprising:

a rear wall of the dispenser body;

a rear bevel secured to the front wall and the rear wall wherein the rear bevel angles downward from the top wall towards the rear wall, wherein the rear bevel extends from the side wall to the end cap.

10. The device of claim 1 further comprising:

a side wall of the dispensing body;

an end cap that attaches to the dispensing body opposite of the side wall, wherein the end cap detaches and attaches to the dispensing body;

a rod installed between the side wall and the end cap;

a stopper wherein the rod inserts into the stopper to enable the stopper to travel along the rod; and a fastener inserted into the stopper that contacts the rod to secure the stopper to the rod wherein the fastener limits movement of the stopper laterally across the rod.

11. A rolled material dispensing device for dispensing a rolled material longitudinally forward from the device and cutting a portion of the rolled material, the device comprising:

a dispenser body in which the rolled material is positioned;

a base of the dispenser body;

a front wall of the dispenser body extending vertically upward from the base;

a top wall of the dispenser body;

a rear wall of the dispenser body located opposite of the front wall;

a dispensing aperture of the dispenser body located vertically above the front wall to provide an exit of the rolled material from the dispenser body longitudinally forward through the dispensing aperture;

a lid secured to the dispenser body wherein the lid adjusts to an open position that exposes the dispensing aperture and a closed position that reduces a vertical opening of the dispensing aperture, wherein the dispensing aperture is formed vertically between the front wall and the lid in the closed position;

an upper portion of the lid that attaches to the dispenser body, wherein the upper portion extends from the rear wall to the front wall when the lid is adjusted to the closed position;

a front portion of the lid that extends downward from the upper portion, wherein the front portion extends down toward the base when the lid is adjusted to the closed position;

a blade secured to the front portion of the lid;

a track in the front portion of the lid wherein the blade travels laterally across the track in the lid;

a dispenser lip secured to the front wall wherein the dispenser lip extends longitudinally rearward from the front wall and then extends vertically upward longitudinally behind the front wall, wherein the dispenser lip extends vertically above the dispensing aperture at a position located longitudinally behind the front wall;

a front end of the dispenser lip located below the dispensing aperture, wherein the front end of the dispenser lip is fixed to the front wall;

a top of the dispenser lip located longitudinally rearward of the front end, wherein the top is located vertically above the dispensing aperture, wherein the front end of the dispenser lip is located below the top of the dispenser lip.

12. The device of claim 11, wherein the dispenser lip curves upward along a longitudinal axis when extending longitudinally rearward from the front wall, wherein the dispenser lip extends longitudinally behind the front wall towards the rear wall of the dispenser body, wherein an upper surface of the front end of the dispenser lip is located vertically below the dispensing aperture, wherein the upper surface of the dispenser extends longitudinally behind the dispensing aperture, wherein the upper surface of the top of the dispenser lip extends vertically upward above the dispensing aperture at a position located longitudinally behind the dispensing aperture.

13. The device of claim 12 further comprising:

an adjustment aperture longitudinally between the front portion of the lid in the closed position and the dispensing lip, wherein the adjustment aperture creates space between the front portion of the lid and the dispensing lip, wherein the adjustment aperture extends from the track to an exit of the dispensing body at the dispensing aperture located vertically between the lid and the front wall;

wherein the track is located vertically above the dispensing aperture.

14. The device of claim 12 wherein the track extends laterally across the lid wherein the blade travels laterally across the lid; and wherein the top of the dispenser lip extends vertically above the track when the lid is adjusted to the closed position such that the blade travels along a lateral path vertically below the top of the dispenser lip when the lid is adjusted to the closed position;

wherein the track is located vertically above the dispensing aperture.

15. The device of claim 11 further comprising:

a side wall of the dispensing body;

an end cap that attaches to the dispensing body opposite of the side wall, wherein the end cap detaches and attaches to the dispensing body;

a rod installation aperture of the side wall;

a rod installation aperture of the end cap;

a rod installed between the side wall and the end cap wherein the rod inserts into the rod installation aperture of the side wall and the rod installation aperture of the end cap.

16. The device of claim 15 further comprising:

a stopper wherein the rod inserts into the stopper to enable the stopper to travel along the rod; and a fastener that inserts into the stopper and contacts the rod to secure the stopper to the rod to limit movement of the stopper laterally across the rod.

17. The device of claim 11 wherein the lid adjusted to the closed position maintains vertical separation from the front wall to form a vertical opening for the dispensing aperture between the front wall and the lid.

18. A rolled material dispensing device for dispensing a rolled material and cutting a portion of the rolled material, the device comprising:

a dispenser body in which the rolled material is positioned;

a base of the dispenser body;

a front wall of the dispenser body extending vertically upward from the base;

a top wall of the dispenser body;

a rear wall of the dispenser body located opposite of the front wall;

a dispensing aperture of the dispenser body to provide an opening in the dispensing body for exit of the rolled material from the dispenser body longitudinally forward through the dispensing aperture, a lid secured to the dispenser body wherein the lid adjusts to an open position that increases a size of the opening of the dispensing aperture and a closed position that at least decreases the size of the opening of the dispensing aperture;

an upper portion of the lid that attaches to the dispenser body, wherein the upper portion extends from the rear wall to the front wall when the lid is adjusted to the closed position;

a front portion of the lid that extends vertically downward from the upper portion, wherein the front portion extends down toward the base when the lid is adjusted to the closed position;

a blade secured to the front portion of the lid; and a track in the front portion of the lid wherein the blade travels laterally along the track in the lid;

a side wall of the dispensing body;

an end cap that attaches to the dispensing body laterally opposite of the side wall, wherein the end cap detaches and attaches to the dispensing body;

a rod installation aperture of the side wall;

a rod installation aperture of the end cap;

a rod installed between the side wall and the end cap wherein the rod inserts into the rod installation aperture of the side wall and the rod installation aperture of the end cap;

a stopper wherein the rod inserts into the stopper to enable the stopper to travel along the rod; and a fastener that inserts into the stopper and contacts the rod to secure the stopper to the rod to limit movement of the stopper laterally across the rod; and a dispenser lip secured to the front wall wherein the dispenser lip extends longitudinally rearward from the front wall and then extends vertically upward longitudinally behind the front wall, wherein the dispenser lip extends vertically above the dispensing aperture longitudinally behind the front wall.

19. The device of claim 18, wherein the lid in the closed position maintains vertical separation between the front wall and the front portion of the lid to form a vertical opening between the front wall and the lid at the dispensing aperture.

20. The device of claim 19 further comprising: a front end of the dispenser lip located below the dispensing aperture, wherein the front a top of the dispenser lip located longitudinally rearward of the front end, wherein the top is located vertically above the dispensing aperture, wherein the front end of the dispenser lip is located below the top of the dispenser lip;

wherein the dispenser lip curves upward along a longitudinal axis when extending longitudinally rearward from the front wall to the top, wherein an upper surface of the dispenser lip at the front end is located vertically below the dispensing aperture, wherein the upper surface of the dispenser extends longitudinally behind the dispensing aperture, wherein the upper surface of the dispenser lip at the top extends vertically upward above the dispensing aperture at a position located longitudinally behind the dispensing aperture;

wherein the track is located vertically above the dispensing aperture;

wherein the top of the dispenser lip is located vertically above the dispensing lip;

wherein the dispensing aperture and the track are located vertically between the front end of the dispenser lip and the top of the dispenser lip.

* * * * *